US008937850B2

(12) United States Patent
Mahler et al.

(10) Patent No.: US 8,937,850 B2
(45) Date of Patent: Jan. 20, 2015

(54) TIMEPIECE DISPLAYING THE CURRENT TIME AND INCLUDING AT LEAST FIRST AND SECOND DEVICES DISPLAYING A TIME-RELATED QUANTITY

(75) Inventors: Olivier Mahler, Boecourt (CH); Alphonse Bron, Bassecourt (CH)

(73) Assignee: Compagnie des Montres Longines, Francillon S.A., St-Imier (CH)

( * ) Notice: Subject to any disclaimer, the term of this patent is extended or adjusted under 35 U.S.C. 154(b) by 914 days.

(21) Appl. No.: 12/525,268

(22) PCT Filed: Jan. 28, 2008

(86) PCT No.: PCT/EP2008/050973

§ 371 (c)(1), (2), (4) Date: Jul. 30, 2009

(87) PCT Pub. No.: WO2008/095813

PCT Pub. Date: Aug. 14, 2008

(65) Prior Publication Data

US 2010/0027381 A1 Feb. 4, 2010

(30) Foreign Application Priority Data

Jan. 30, 2007 (EP) ..... 07001959

(51) Int. Cl.
*G04B 19/24* (2006.01)
*G04B 19/25* (2006.01)

(52) U.S. Cl.
CPC ..... *G04B 19/25* (2013.01)
USPC ..... 368/38; 368/28; 368/220

(58) Field of Classification Search
USPC ..... 368/28, 220, 231, 31, 34, 37–38, 368/221–222
See application file for complete search history.

(56) References Cited

U.S. PATENT DOCUMENTS

| | | | | |
|---|---|---|---|---|
| 3,438,196 | A * | 4/1969 | Teramoto et al. | 368/38 |
| 3,678,683 | A * | 7/1972 | Cielaszyk | 368/133 |
| 4,050,233 | A | 9/1977 | Ingenieur | |
| 6,738,316 | B2 * | 5/2004 | Gabathuler et al. | 368/28 |
| 6,761,478 | B2 * | 7/2004 | Schmiedchen et al. | 368/101 |
| 8,118,480 | B2 * | 2/2012 | Gigandet et al. | 368/133 |
| 2002/0080686 | A1 * | 6/2002 | Rochat et al. | 368/37 |
| 2002/0167864 | A1 * | 11/2002 | Watanabe et al. | 368/38 |
| 2005/0128875 | A1 | 6/2005 | Bron | |
| 2007/0109916 | A1 * | 5/2007 | Bron | 368/35 |
| 2010/0177603 | A1 * | 7/2010 | Kitahara et al. | 368/80 |

FOREIGN PATENT DOCUMENTS

| | | |
|---|---|---|
| CH | 524 853 | 3/1972 |
| EP | 1544691 A1 | 6/2005 |
| FR | 2 203 994 | 5/1974 |

OTHER PUBLICATIONS

International Search Report issued in corresponding application No. PCT/EP2008/050973, completed Sep. 10, 2008 and mailed Sep. 17, 2008.

* cited by examiner

*Primary Examiner* — Sean Kayes
(74) *Attorney, Agent, or Firm* — Griffin & Szipl, P.C.

(57) ABSTRACT

Timepiece displaying the current time and including at least first and second display devices for a time-related quantity, the first and second display devices each being driven by a drive mechanism including a drive wheel (2; 2*a*), which is itself driven by the movement of the timepiece (3), at least the drive wheel (2; 2*a*) of one of the drive mechanisms carrying a finger (4; 4*a*) via which the wheel drives the corresponding display device, the timepiece (3) being characterized in that the finger (4; 4*a*) is friction fitted onto the drive wheel (2; 2*a*).

10 Claims, 4 Drawing Sheets

TIMEPIECE DISPLAYING THE CURRENT TIME AND INCLUDING AT LEAST FIRST AND SECOND DEVICES DISPLAYING A TIME-RELATED QUANTITY

This is a National Phase Application in the United States of International Patent Application No. PCT/EP2008/050973 filed Jan. 28, 2008, which claims priority on European Patent Application No. 07001959.1, filed Jan. 30, 2007. The entire disclosures of the above patent applications are hereby incorporated by reference.

FIELD OF THE INVENTION

The present invention concerns a mechanism for adjusting a device displaying a time quantity. More specifically, the present invention concerns an adjustment mechanism that can ensure that a device displaying a time quantity, such as a date display, will be incremented as closely as possible to midnight.

BACKGROUND OF THE INVENTION

Timepieces, which are able to provide, in addition to the current time, at least two time-related indications, such as the date and the day of the week are already known in the state of the art. One example of this type of timepiece is shown with reference to FIGS. 1 and 2, annexed to this Patent Application and which respectively show a plan view of the timepiece dial and a plan view of the time quantity display mechanism.

Designated as a whole by the general reference numeral 3, the timepiece includes at the centre thereof a set of time zone hands, formed by an hour hand 5*a*, a minute hand 5*b* and a second hand 5*c*, which move above a circular dial 7. The time zone mechanism has already been disclosed in EP Patent Application No. 1544691 in the name of the Applicant and will not, therefore, be described further here.

The timepiece whose time quantity display mechanism is shown in plan in FIG. 2 is a time zone watch including a retrograde 24-hour display for the local time of the place where the wearer of the watch usually lives and a 12-hour display for the time zone of the place where the wearer of the watch is staying temporarily.

Watch 3 is completed by:

- a retrograde date display formed by a hand 9*a*, which moves opposite a scale 9*b* in the shape of an arc of a circle extending between the "1$^{st}$", and the "31$^{st}$";
- a retrograde day of the week display, formed by a hand that moves along a scale 11*b* marked from "Monday" to "Sunday";
- a retrograde 24-hour display formed by a hand 13*a* that moves along a scale 13*b* in the shape of an arc of a circle extending between "0" and "24".

The watch display is completed by a small seconds indication 15.

As can be seen in FIG. 2, the time quantity display mechanism includes, in particular, at the centre thereof, an intermediate wheel 1, which is secured to an hour wheel 1*a*. In other words, intermediate wheel 1 rotates clockwise and completes one revolution in twelve hours. This intermediate wheel 1 meshes with a date drive wheel 2, which rotates anticlockwise at the rate of one revolution in twenty-four hours. This date drive wheel 2 carries a finger 4, via which it drives, at the rate of one step per day, a date wheel 6, which is indexed by a jumper spring 8, and which carries a cam 10. At one place on the profile thereof, cam 10 has a steep side 12, which marks the change between the date of the last day of a given month and the date of the first day of the following month, in other words between the "31$^{st}$" day of one month and the "1$^{st}$" day of the next month.

The time quantity display mechanism is completed by a control lever 14, provided at one end thereof with an arm 16, via which the lever abuts against cam 10 in a normal operating period, and including at the other end thereof a rack 18, via which it meshes with the date display wheel 20, which carries the date indicator 9*a* (not visible in FIG. 2). The control lever 14 is pivoted at 22, whereas a second lever 24, called the return lever, is pivoted at 26. This return lever 24 has a similar structure to that of control lever 14, including, in particular, a rack 28, via which it meshes with the date display wheel 20. As can be seen upon examining FIG. 2, return lever 24 is biased by spring element 30, which tends to rotate the lever clockwise. In turn, return lever 24 tends thus to rotate control lever 14 clockwise and to hold arm 16 thereof abutting against the profile of cam 10.

As can be seen upon examining the drawing, in the example shown, spring element 30 is integral with return lever 24 and abuts against a stop member 32 for pre-winding. In order to achieve this result, the lever could, for example, be made via a LIGA photoetching technique. It goes without saying, however, that spring element 30 could be made in the form of a separate part from return lever 24.

In addition to the date display device, the time quantity display mechanism shown in FIG. 2 includes a day of the week display device, which has essentially the same structure as the date display device. More specifically, this day of the week display mechanism includes a day drive wheel 2*a*, which rotates anticlockwise, driven by intermediate wheel 1. This day drive wheel 2*a* carries a finger 4*a* via which it drives, at a rate of one step per day, a day wheel 6*a*, which includes fourteen teeth and which thus completes one revolution in fourteen days. Thus, day wheel 6*a* carries a cam 10*a*, which has a double cam profile with two steep sides $\mathbf{12}a_1$ and $\mathbf{12}a_2$, which are symmetrical relative to the geometrical centre of said cam 10*a*. Each of the two steep sides $\mathbf{12}a_1$ and $\mathbf{12}a_2$ of cam 10*a* marks the change of the day indicator from the last day of one week to the first day of the following week, namely from Sunday to Monday. It will be noted that day wheel 6*a* is indexed by a jumper spring 8*a*.

The day display device is completed by a control lever 14*a*, which, via arm 16*a* thereof, abuts against the profile of cam 10*a* and which meshes, via rack 18*a* thereof, with a day display wheel 20*a*. A return lever 24*a* is also provided, stressed by a spring 30*a* and which, at one end thereof, includes a rack 28*a*, via which it meshes with the day display wheel 20*a*.

It has already been specified above that the watch also includes a 24-hour local time display. Consequently, when the position of the hour and minute hands is set, the 24-hour indication must also be set. Thus, the 24-hour display device includes an intermediate wheel 34, driven by the watch movement and which meshes with a 24-hour wheel 6*b*, which carries a cam 10*b*. At one place on the profile thereof, this cam 10*b* has a steep side 12*b*, which marks the change from the twenty-fourth hour of one day to the first hour of the following day. A control lever 14*b* abuts, via arm 16*b* thereof, against the profile of cam 10*b* and meshes with a 24-hour display wheel via rack 18*b* thereof. Likewise, a return lever 24*b*, biased by a spring element 30*b*, meshes, via rack 28*b* thereof, with 24-hour display wheel 20*b*.

A watch fitted with a single time quantity indication device, such as a watch that has only a current time display hand set and one date indicator hand, does not raise any particular problems. Indeed, the accuracy of the date display jump from one date indication to the next date indication around midnight is guaranteed by the accuracy with which the date indicator hand is driven onto its arbor.

The same is not true of a watch that includes, for example, a 24-hour display and a date display device with hands. Indeed, in such case, when the watch is assembled, one must ensure that arm 16*b* of control lever 14*b* has actually dropped along the steep side 12*b* of cam 10*b*. This position of arm 16*b* of control lever 14*b* corresponds exactly to midnight. Once one has ensured that arm 16*b* has indeed dropped along the side 12*b* of cam 10*b*, the 24-hour display indicator hand can then be driven precisely into place. Next, as the date drive wheel 2 has already been assembled, the centre wheel 1*a* and its intermediate wheel 1 are assembled. Since the kinematic connection between centre wheel 1*a* and intermediate wheel 34, and between centre wheel 1*a* and date drive wheel 2, is not the same, there may be a shift of one or several teeth between intermediate wheel 1 and date drive wheel 2. The result of this shift between the toothings of intermediate wheel 1 and plate 5 of date drive wheel 2, is that a time difference of up to 15 to 20 minutes may be observed between the jump at midnight of the 24 hour display and that of the date display device.

The same problem arises with a watch including two time quantity display devices, such as the date indication and the day of the week indication. When arm 16 of control lever 14 has dropped along steep side 12 of cam 10, we know that it is midnight. The current time display hand and the date indicator hand can then be precisely driven into place. However, since the kinematic connections between intermediate wheel 1 and date drive wheel 2, and between intermediate wheel 1 and day drive wheel 2*a*, are not the same, there may be a difference of several minutes between the jumps of the date indicator hand and the day indicator hand.

It will be clear that such differences between the jumps of the indicator hands for the different time quantities are not appreciated by the wearer of the watch.

It is an object of the present invention to overcome this problem by providing a mechanism that can adjust, with precision, the moment at which a time quantity display device in a timepiece jumps.

SUMMARY OF THE INVENTION

The present invention therefore concerns a timepiece that displays the current time and includes at least first and second time quantity display devices, said first and second display devices each being driven by a drive mechanism including a drive wheel, which is itself driven by the timepiece movement, wherein at least the drive wheel of one of the drive mechanisms carries a finger via which it drives the corresponding display device, the timepiece being characterized in that the finger is friction fitted on the drive wheel.

Owing to these features, the present invention provides a timepiece, wherein the jumps in information provided by the first and second display devices can be very precisely synchronised to occur in an almost simultaneous manner. Indeed, when the timepiece is assembled, the first display device for a first time quantity, is synchronised with the current time display, such that the quantity displayed is incremented by one step at a determined change of time, typically at midnight. As regards the second display device, the position of the finger can be adjusted relative to the position of the drive wheel, which is determined by the position of the kinematic chain that connects the drive wheel to the movement, by moving the finger relative to the plate of the drive wheel, which is made possible owing to their friction coupling. In doing so, the position of the finger is also altered relative to the display device that it drives, which enables the moment at which the displayed quantity is incremented to be precisely controlled.

According to a complementary feature of the invention, a first display device may be a date display device, a second display device may be a day of the week display device and a third display device may be a 24 hour display, the timepiece including any combination of at least two of these display devices.

According to another feature of the invention, the display devices each include an indicator hand.

According to yet another feature of the invention, the finger is secured to a spring by a first pin about which it can pivot. The pivoting angle of said finger is limited by a second pin to which it is secured and which is inserted in a hole made in the plate of the drive wheel. The spring holds the finger in a position, wherein the finger is meshed with the toothing of a driven wheel of the display device for driving said wheel clockwise or anticlockwise. The spring is friction fitted on the drive wheel so that it can make up for any play, an aperture being made for this purpose in the drive wheel plate, so that a tool can be inserted for moving said spring relative to the drive wheel plate.

BRIEF DESCRIPTION OF THE DRAWINGS

Other features and advantages of the present invention will appear more clearly upon reading the following detailed description of an example embodiment of the timepiece according to the invention, this example being given purely by way of non-limiting illustration, with reference to the annexed drawing, in which.

DETAILED DESCRIPTION OF THE ILLUSTRATIVE EMBODIMENTS

The present invention proceeds from the general inventive idea, which consists in providing a timepiece capable of displaying at least two time quantities, in addition to the current time. The display of these time quantities is linked to the current time display and has to be altered simultaneously at a determined change of time, typically at midnight. The time quantity display devices may be a date display device, a day of the week display device, a 24-hour display device or other display device. The precision with which the time quantity, for example the date, displayed by the first display device is incremented by one step when the time changes to midnight, is only a function of the precision with which the date hand is driven onto its arbor. However, the instant when the time quantity, for example the day, displayed by the second display device is incremented by one step when the time changes to midnight is determined by the position of the drive wheel of the day display device and thus by the position of the centre wheel. To date, no means have been available for finely adjusting the jump by the day indicator hand, such that a difference of up to 15 to 20 minutes could be observed between the moment when the date indicator hand jumped and the moment when the day indicator hand jumped, which was not very satisfactory for the wearer of the watch. The present invention provides a drive mechanism including a drive wheel which is driven by the gear train of the timepiece movement, and which itself drives a time quantity display device via a finger that is friction fitted onto the drive wheel. Because the finger is friction fitted onto the drive wheel, its position relative to said wheel can be altered, and thus the moment at which the finger will activate the time quantity display device can be adjusted. Therefore, by driving the indicator hand of the first display device precisely into position and adjusting the relative position of the drive wheel and the finger driving the second display device, one can ensure that the indications provided by the two display devices will be incremented simultaneously or almost simultaneously, at the desired moment.

Figure 1:
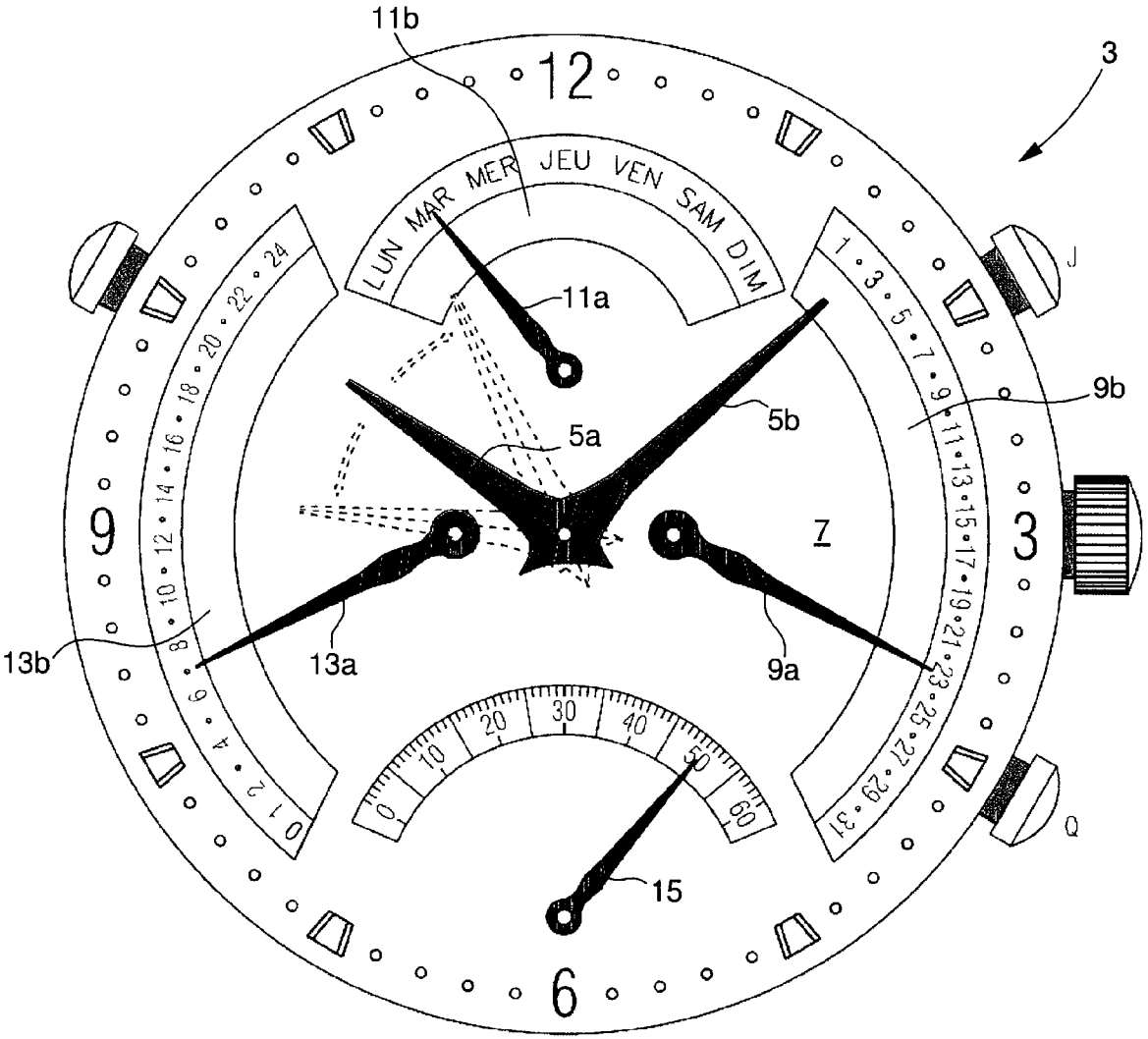
FIG. 1, already cited, is a plan view of the timepiece dial according to the invention.
Figure 2:
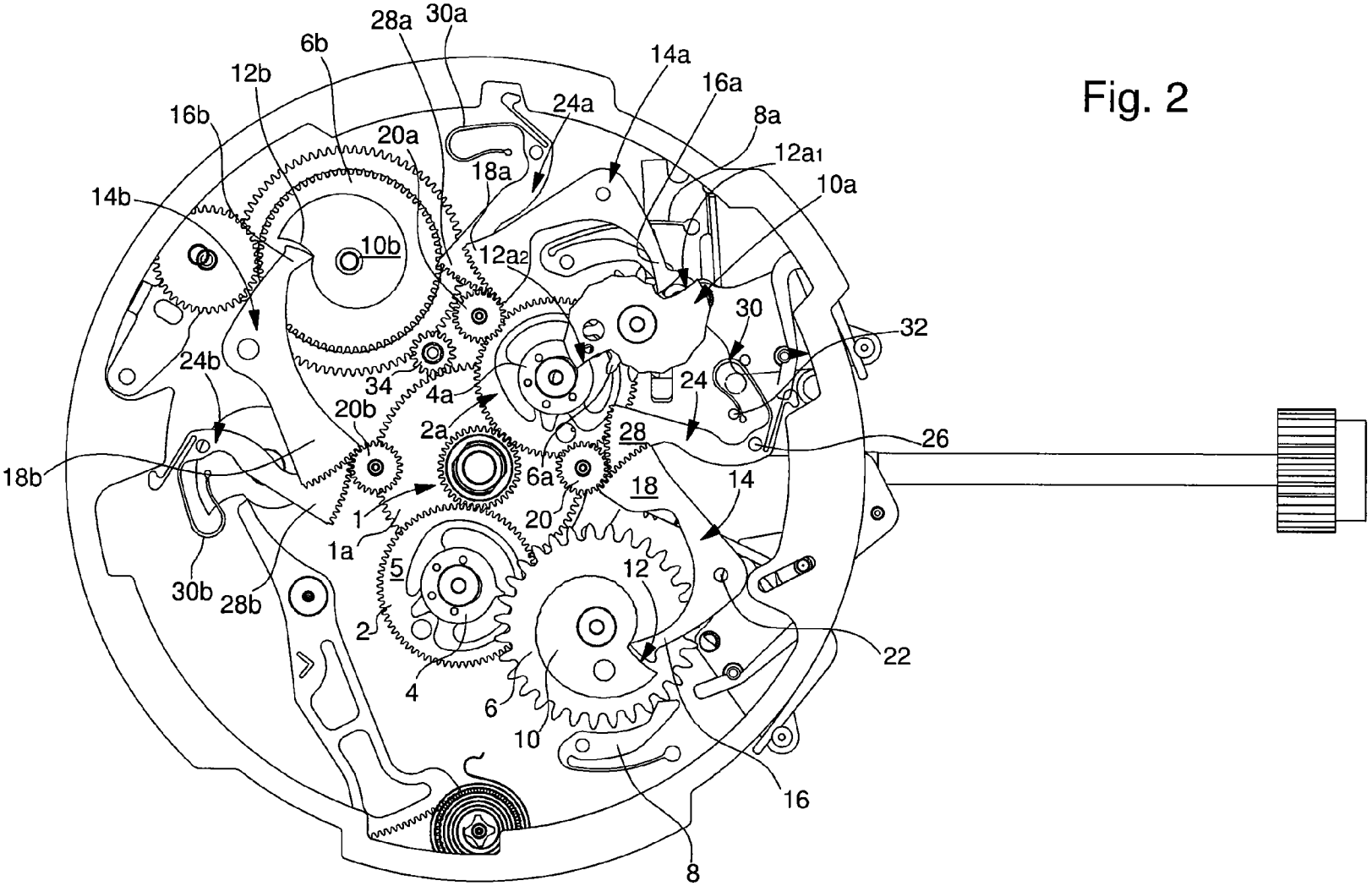
FIG. 2, already cited, is a plan view of the time quantity display mechanism.

The present invention will be described with reference to the date display device shown with reference to FIGS. 1 and 2 described above. it goes without saying that this example is given purely by way of illustration, and that the present invention can be applied in an identical manner to the day display device, which is also shown in FIGS. 1 and 2 annexed to the present Patent application. More generally, the present invention applies to any type of display for a time-related quantity, such as the month of the year or moon phase indication.

Figure 3:
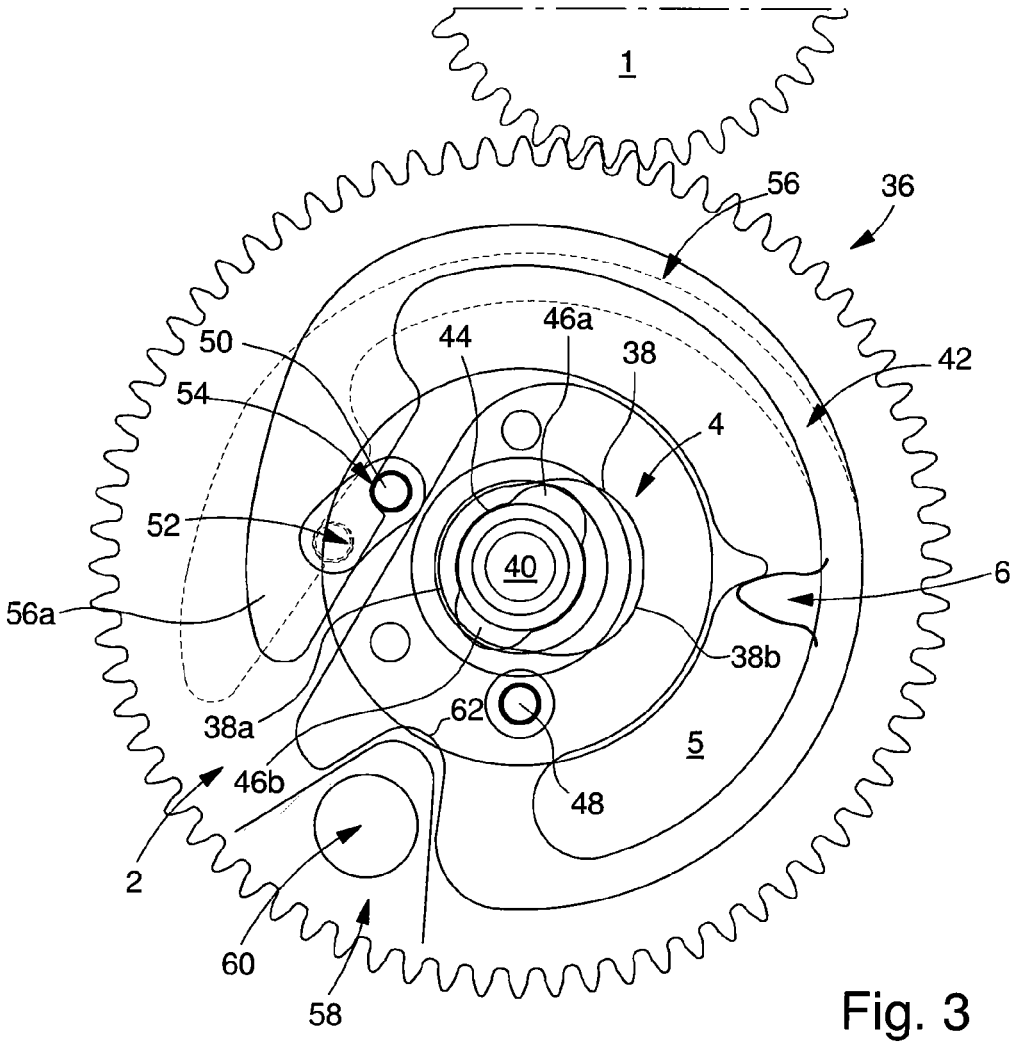
FIG. 3 is a plan view of a drive mechanism for a time quantity display device according to the invention.

The drive mechanism according to the invention is shown respectively in plan and cross-section in FIGS. 2 and 3 annexed to this Patent Application. Designated as a whole by the general reference numeral 36, this mechanism includes a date drive wheel 2, which is driven by the hour wheel 1*a* of the timepiece movement, via an intermediate wheel 1, and which drives in turn, via finger 4, the date wheel 6 of the date display device.

Drive wheel 2 carries finger 4. Finger 4 therefore has an oblong aperture 38, through which it is fitted on a hub of said drive wheel 2. A spring 42 holds finger 4 in a position, wherein finger 4 is meshed with the toothing of date wheel 6 for driving said wheel clockwise or anticlockwise.

Figure 4:
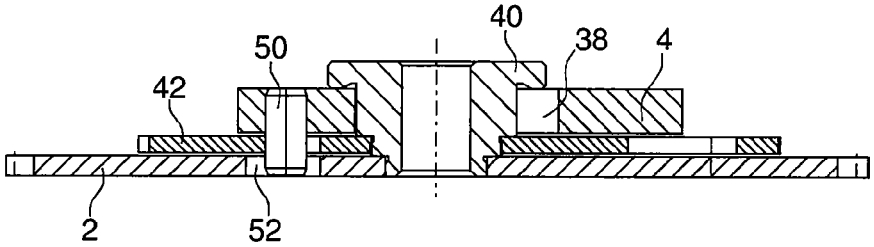
FIG. 4 is a cross-section of the mechanism of FIG. 3.

As can be seen upon examining FIGS. 3 and 4, spring 42 is arranged between plate 5 of drive wheel 2 and finger 4. Thus, spring 42 has a circular aperture 44, with two diametrically opposite lugs 46*a* and 46*b*, via which it is friction fitted onto hub 40 of said drive wheel 2. It will be noted that, in normal operating mode, spring 42 is stationary relative to drive wheel 2. The friction fit of said spring 42 on said drive wheel 2, permitted by the presence of the two lugs 46*a* and 46*b*, is provided to enable the drive mechanism 36 according to the invention to be finely adjusted, as described below.

Finger 4 is coupled with spring 42 by means of a pin 48. This pin 48 is driven into finger 4, but is free to pivot in a hole made in spring 42, in which it is inserted. This pin 48 constitutes the pivoting point of finger 4. There is a second pin 50, also driven into finger 4 and which is inserted in an oblong aperture 52, arranged in drive wheel 2, in which said pin 50 is free to move. As can be observed upon examining FIG. 3, pin 50 is positioned in a recess 54, provided towards the free end 56*a* of an elastic arm 56 of substantially circular shape, in spring 42.

In the normal operating mode of the drive mechanism, as illustrated in FIG. 3, finger 4 must be rigid. This means that finger 4 must be able to drive date wheel 6 clockwise or anticlockwise without being wound, like an instantaneous or semi-instantaneous type spring mechanism. It should also be recalled that "normal operating mode" means the periods where intermediate wheel 1 drives drive wheel 2 either because intermediate wheel 1 is driven clockwise by the timepiece movement, either because intermediate wheel 1 is driven clockwise or anticlockwise via activation of a winding stem, for example, in order to set the time. In other words, in normal operating mode, intermediate wheel 1 rotates and drives drive wheel 2, which itself drives date wheel 6. This is made possible by the fact that spring 42 exerts sufficient retaining torque on finger 4 to enable said finger 4 to overcome the slight torque exerted by date wheel 6. Likewise, finger 4 is stopped by the semi-circular part 38*a* of its oblong aperture 38 against hub 40 of drive wheel 2.

As already mentioned above, spring 42 is almost permanently mounted on hub 40 of drive wheel 2, such that, only a tool 58 inserted in an aperture 60, made in said drive wheel 2 in a recess 62 of spring 42, can move said spring 42 slightly relative to said hub 40 by a few degrees clockwise or anticlockwise to make up for any play and to synchronise the date jump with the day jump.

It goes without saying that the present invention is not limited to the embodiment that has just been described and that those skilled in the art could envisage various simple alterations and variants, without departing from the scope of the invention defined by the annexed claims. It will be clear, in particular, that in the case of a watch fitted with a date display of the type described above, and an additional display device, for example for the day of the week, if the drive mechanism of the date display device is made in accordance with the invention, it is not necessary to provide a similar mechanism for driving the day display device. Indeed, the drive wheels are mounted first of all, then the wheels that carry the cams and finally the intermediate wheel at the centre. The mechanism is then moved forward to the time at which the rack of the display device, which, as appropriate, may not be fitted with the device according to the invention, is ready to drop along the steep side of the cam, then the position of the finger of the other display device is adjusted such that the corresponding rack is also ready to drop along the steep profile of the cam against which it is abutting. If both time quantity display devices are provided with a friction fit finger, one need only observe which of the two racks drops first, then adjust the position of the finger of the other display device, such that the corresponding rack drops at the same time, or almost the same time, as the other rack. Finally, the indicator hands need only to be driven onto their respective arbors.

Figure 5:
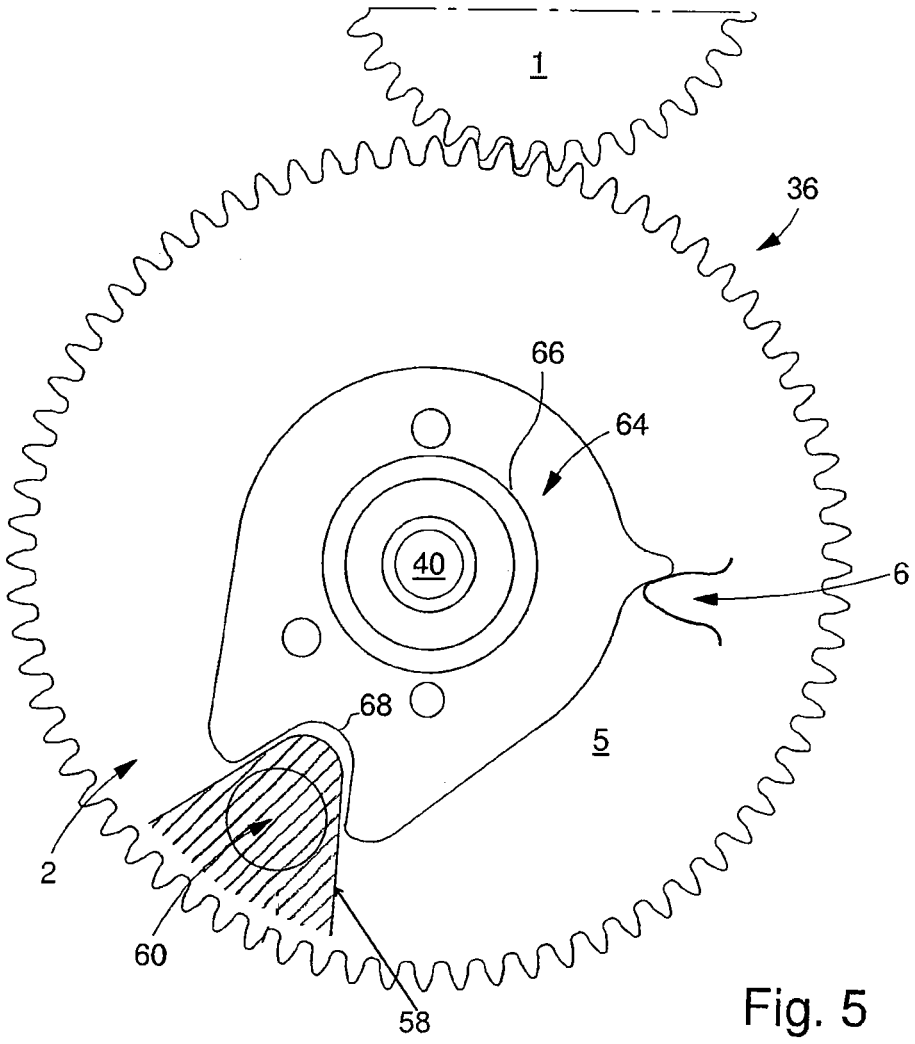
FIG. 5 is a plan view of a simplified embodiment of the invention.

A simplified embodiment of the invention is shown with reference to FIG. 5 annexed to this Patent Application. According to this embodiment, finger 64 is directly friction fitted onto hub 40 of drive wheel 2, through an aperture 66. One can therefore omit spring 42, which considerably simplifies the construction of the mechanism and thus allows savings to be made in terms of cost. Finger 64 must, however, be altered slightly so that it has a recess 68 in which tool 58 can be inserted in order to allow the fitter to pivot finger 64 slightly by several degrees clockwise or anticlockwise and thus ensure almost perfect synchronism between the jumps of the time quantity indicators.

The invention claimed is:

1. A timepiece displaying a current time, the timepiece comprising:

(a) at least first and second display devices for a time-related quantity;

(b) at least first and second drive mechanisms, wherein the first display device is driven by the first drive mechanism including a first drive wheel and the second display device is driven by the second drive mechanism including a second drive wheel, wherein both the first drive wheel and the second drive wheel are driven by a movement of the timepiece, wherein at least one of the first drive wheel and the second drive wheel carries a finger, wherein the at least one of the first drive wheel and the second drive wheel drives the corresponding display device by the finger, wherein the finger is directly friction fitted onto a hub of the at least one of the first drive wheel and the second drive wheel, wherein at least one of the first drive wheel and the second drive wheel comprises an aperture formed to receive a tool, and wherein the finger further comprises a recess formed to receive the tool, and wherein the finger is pivotable, relative to at least one of the first drive wheel and the second drive wheel, by clockwise or anticlockwise movement of the tool.

2. The timepiece according to claim 1, wherein the aperture is adjacent to the recess.

3. A timepiece displaying a current time, the timepiece comprising:

(a) at least first and second display devices for a time-related quantity;

(b) at least first and second drive mechanisms, wherein the first display device is driven by the first drive mechanism including a first drive wheel and the second display device is driven by the second drive mechanism including a second drive wheel, wherein both the first drive wheel and the second drive wheel are driven by a movement of the timepiece, wherein at least one of the first drive wheel and the second drive wheel carries a finger, wherein the at least one of the first drive wheel and the second drive wheel drives the corresponding display device by the finger, wherein the finger is friction fitted onto at least one of the first drive wheel and the second drive wheel, wherein the finger is directly friction fitted onto a hub of the at least one of the first drive wheel and the second drive wheel, wherein the spring is arranged between at least one of the first drive wheel and the second drive wheel and the finger, wherein the spring has a circular aperture fitted with two diametrically opposite lugs, and wherein the finger is friction fitted onto the hub of the at least one of the first drive wheel and the second drive wheel by the lugs.

4. The timepiece according to claim 3, wherein the finger is secured to the spring via a pin about which the finger can pivot, wherein the spring holds the finger in a position in which the finger is meshed with teeth of a driven wheel of the corresponding display device for driving the driven wheel of the corresponding display device clockwise or anticlockwise, wherein the spring is friction fitted onto at least one of the first drive wheel and the second drive wheel so as to make up for any play, and wherein an aperture is made in at least one of the first drive wheel and the second drive wheel and adapted for a tool to be inserted to move the spring relative to at least one of the first drive wheel and the second drive wheel.

5. The timepiece according to claim 4, wherein a pivoting angle of the finger is limited by a second pin to which the finger is secured and which is inserted in a hole made in at least one of the first drive wheel and the second drive wheel.

6. The timepiece according to claim 4, wherein the aperture in at least one of the first drive wheel and the second drive wheel is located in a recess of the spring.

7. The timepiece according to claim 6, wherein a pivoting angle of the finger is limited by a second pin to which the finger is secured and which is inserted in a hole made in at least one of the first drive wheel and the second drive wheel.

8. A method of adjusting a moment at which an indication provided by a time quantity display device of a timepiece is incremented, wherein the time quantity display device is driven by a drive wheel, wherein the drive wheel is driven by a movement of the timepiece, and wherein the drive wheel carries a finger via which the drive wheel drives the time quantity display device, the method comprising the steps of:

(a) friction fitting the finger onto the drive wheel, and (b) adjusting an angular position of the finger by pivoting the finger with respect to the drive wheel in order to adjust the moment at which the display device is triggered, wherein the drive wheel has an aperture formed to receive a tool, wherein the finger has a recess formed to receive a tool, and wherein the finger is pivoted by a tool inserted into the aperture and the recess.

9. A timepiece displaying a current time, the timepiece comprising:

(a) at least first and second display devices for a time-related quantity;

(b) at least first and second drive mechanisms, wherein the first display device is driven by the first drive mechanism including a first drive wheel and the second display device is driven by the second drive mechanism including a second drive wheel, wherein both the first drive wheel and the second drive wheel are driven by a movement of the timepiece, wherein at least one of the first drive wheel and the second drive wheel carries a finger, wherein the at least one of the first drive wheel and the second drive wheel drives the corresponding display device by the finger, wherein the finger is friction fitted onto the at least one of the first drive wheel and the second drive wheel via a spring, wherein at least one of the first drive wheel and the second drive wheel comprises an aperture formed to receive a tool, and wherein the finger further comprises a recess formed to receive the tool, and wherein the finger is pivotable, relative to at least one of the first drive wheel and the second drive wheel, by clockwise or anticlockwise movement of the tool.

10. A timepiece displaying a current time, the timepiece comprising:

(a) at least first and second display devices for a time-related quantity;

(b) at least first and second drive mechanisms, wherein the first display device is driven by the first drive mechanism including a first drive wheel and the second display device is driven by the second drive mechanism including a second drive wheel, wherein both the first drive wheel and the second drive wheel are driven by a movement of the timepiece, wherein at least one of the first drive wheel and the second drive wheel carries a finger, wherein the at least one of the first drive wheel and the second drive wheel drives the corresponding display device by the finger, wherein the finger is friction fitted onto at least one of the first drive wheel and the second drive wheel, wherein the finger is friction fitted onto the at least one of the first drive wheel and the second drive wheel via a spring, wherein the spring is arranged between at least one of the first drive wheel and the second drive wheel and the finger, wherein the spring has a circular aperture fitted with two diametrically opposite lugs, and wherein the finger is friction fitted onto the hub of the at least one of the first drive wheel and the second drive wheel by the lugs.

* * * * *